US010429018B2

(12) United States Patent
Werr et al.

(10) Patent No.: US 10,429,018 B2
(45) Date of Patent: Oct. 1, 2019

(54) RECESSED LIGHT FIXURE

(71) Applicant: Hubbell Incorporated, Shelton, CT (US)

(72) Inventors: Martin Werr, Easley, SC (US); Randy Lewis, Greenville, SC (US); Dhavalkumar Patel, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/885,173

(22) Filed: Jan. 31, 2018

(65) Prior Publication Data

US 2018/0216792 A1 Aug. 2, 2018

Related U.S. Application Data

(60) Provisional application No. 62/452,716, filed on Jan. 31, 2017.

(51) Int. Cl.

| | |
|---|---|
| ***F21V 15/00*** | (2015.01) |
| ***F21V 17/00*** | (2006.01) |
| ***F21S 8/02*** | (2006.01) |
| ***F21V 21/04*** | (2006.01) |
| ***F21V 11/02*** | (2006.01) |
| ***F21V 11/06*** | (2006.01) |
| *F21V 15/01* | (2006.01) |
| *F21S 8/04* | (2006.01) |
| *F21V 23/04* | (2006.01) |

(52) U.S. Cl.

CPC ..... *F21S 8/026* (2013.01); *F21V 11/02* (2013.01); *F21V 11/06* (2013.01); *F21V 21/048* (2013.01); *F21S 8/04* (2013.01); *F21V 15/01* (2013.01); *F21V 23/0471* (2013.01)

(58) Field of Classification Search

CPC ... F21S 8/026; F21S 8/04; F21S 8/046; F21V 11/02; F21V 11/04; F21V 11/06; F21V 11/065; F21V 15/01–015; F21V 21/04–049

USPC ..... 362/147–150, 217.03–217.04, 362/217.1–217.17, 279, 290–292, 325, 362/342, 354, 364–367

See application file for complete search history.

(56) References Cited

U.S. PATENT DOCUMENTS

| | | | | |
|---|---|---|---|---|
| 3,600,570 A * | 8/1971 | Okada | F21V 3/00 | 362/330 |
| 6,238,064 B1 * | 5/2001 | Caferro | F21V 11/02 | 362/290 |
| 9,285,099 B2 * | 3/2016 | Pickard | F21V 7/0008 | |
| 2013/0201670 A1 * | 8/2013 | Pickard | F21S 8/026 | 362/184 |
| 2013/0223067 A1 * | 8/2013 | Ito | F21V 19/02 | 362/235 |

* cited by examiner

*Primary Examiner* — Jason M Han

(74) *Attorney, Agent, or Firm* — Michael Best & Friedrich, LLP

(57) ABSTRACT

A light fixture includes a housing and a light emitting element. The housing includes a lower edge and is configured to be recessed within a surface. The light emitting element is supported in the housing, and the light emitting element includes a planar surface spaced apart from the lower edge of the housing.

11 Claims, 11 Drawing Sheets

RECESSED LIGHT FIXURE

CROSS-REFERENCE TO RELATED APPLICATION

This application claims the benefit of prior-filed, U.S. Provisional Patent Application No. 62/452,716, filed Jan. 31, 2017, the entire contents of which are incorporated by reference herein.

BACKGROUND

The present disclosure relates to light fixtures, and particularly to a recessed light fixture.

SUMMARY

In one aspect, a light fixture includes a housing and a light emitting element. The housing includes a lower edge and is configured to be recessed within a surface. The light emitting element is supported in the housing, and the light emitting element includes a planar surface spaced apart from the lower edge of the housing.

In another aspect, a light fixture includes a housing, an edge-lit panel light supported in the housing, and a plurality of louvers supported in the housing. The housing includes a lower edge and is configured to be recessed within a surface. The panel light is spaced apart from the lower edge of the housing. The louvers are positioned between the panel light and a lower edge of the housing.

In yet another aspect, a light fixture includes a housing, an edge-lit panel light supported in the housing, and a plurality of louvers supported in the housing. The housing includes a lower edge, an upper edge, and a plurality of side walls extending between the lower edge and the upper edge. The housing further includes a laterally extending flange and is configured to be recessed within a surface. The panel light is supported on the flange and positioned adjacent the upper edge of the housing. The louvers are positioned between the panel light and a lower edge of the housing.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
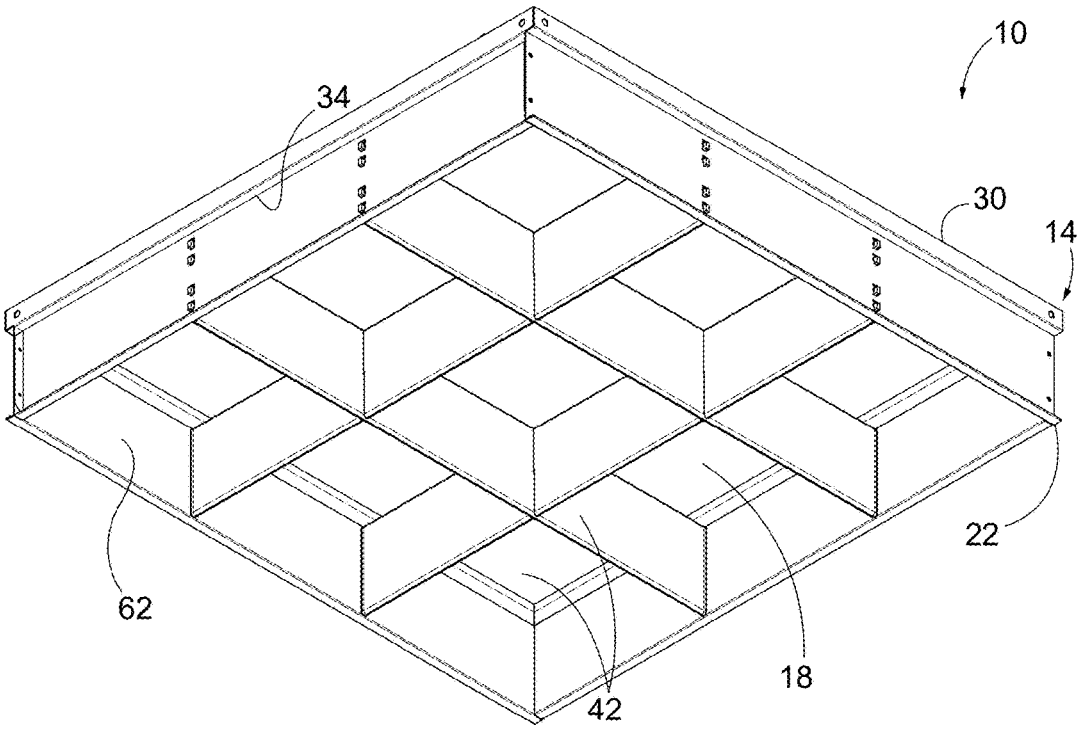
FIG. 1 is a perspective view of a recessed light fixture.
Figure 2:
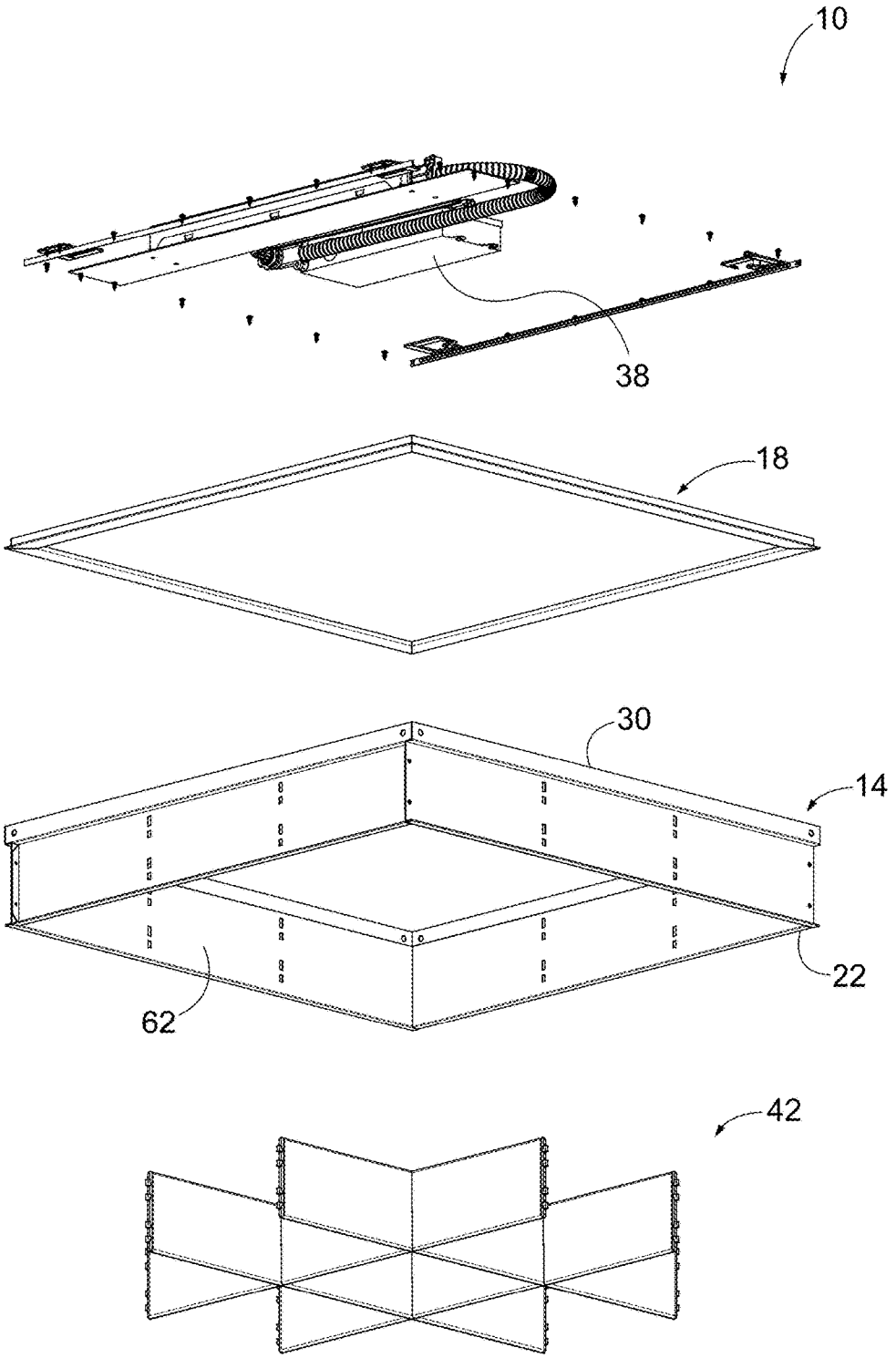
FIG. 2 is an exploded view of the light fixture of FIG. 1.
Figure 3:
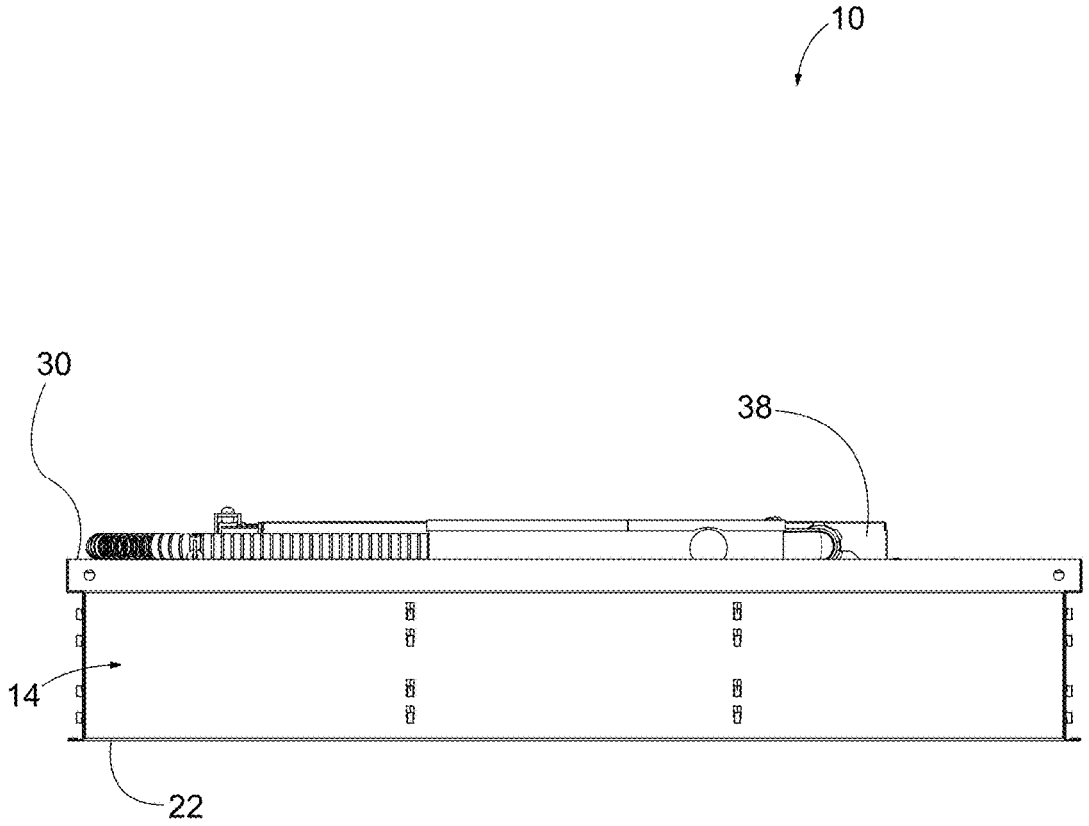
FIG. 3 is a side view of the light fixture of FIG. 1.

As shown in FIGS. 1 and 2, a light fixture 10 includes a frame or housing 14 and a light element 18. In the illustrated embodiment, the housing 14 has a square shape and is configured to be supported in a ceiling (not shown) such that a lower edge 22 of the housing 14 is flush with the ceiling. The light element 18 is an edge-lit flat panel that is recessed in the housing 14. The panel is supported in the housing 14 at a distance from the lower edge 22, and is therefore recessed within the housing 14. In the illustrated embodiment, a portion of the housing 14 adjacent an upper edge 30 extends outwardly to provide a flange 34 on which the panel is supported. In addition, a driver 38 (FIG. 2) may be positioned above the light element 18. As shown in FIG. 3, the overall height of the fixture 10 is relatively short, allowing the fixture 10 to more easily fit within a space above the ceiling.

Figure 4:
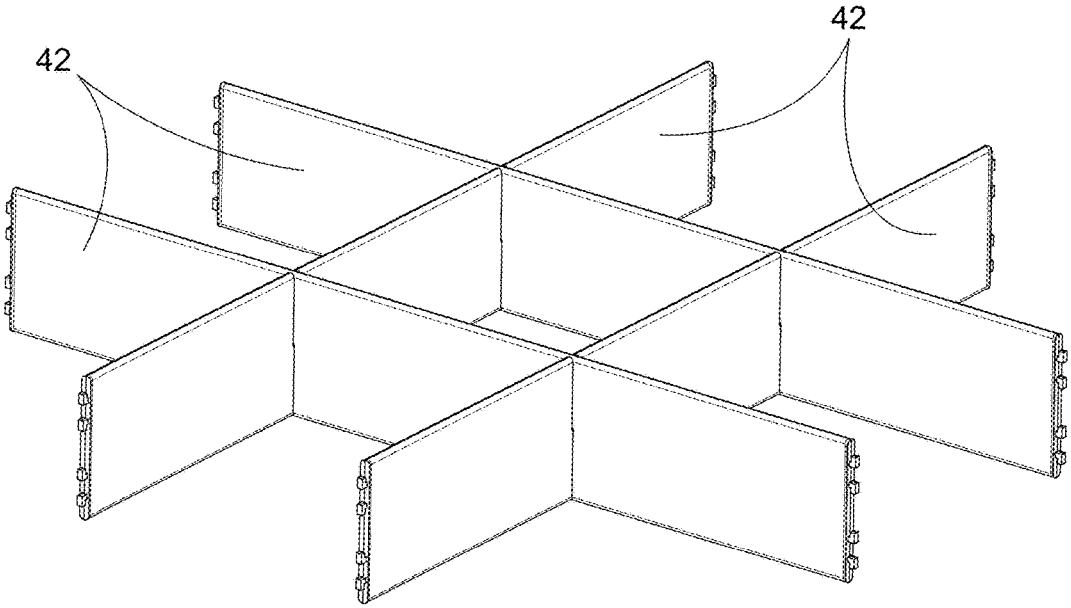
FIG. 4 is a perspective view of louvers.
Figure 5:
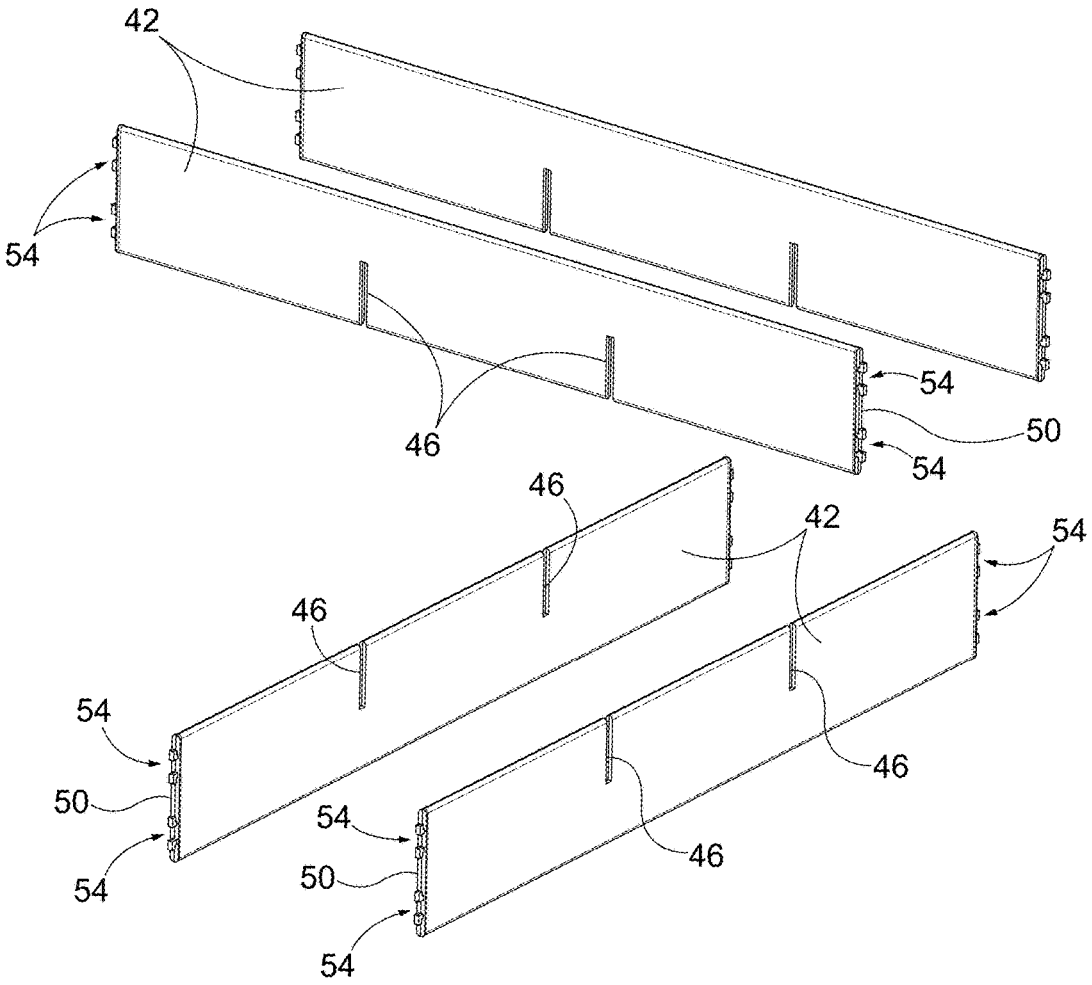
FIG. 5 is an exploded view of the louvers of FIG. 4.

In the embodiment shown in FIGS. 1 and 2, the light fixture 10 also includes reflector members or louvers 42. In the illustrated embodiment, the louvers 42 are oriented in a T-grid and partition the space within the housing 14 into a 3×3 grid. In other embodiments, the louvers 42 could be formed in a different grid configuration and/or a different shape. The louvers 42 are coupled to the housing 14 and positioned adjacent the lower edge 22. The louvers 42 can be positioned between the light element 18 and the lower edge 22 of the housing 14. In the illustrated embodiment, as shown in FIGS. 4 and 5, each louver 42 includes a pair of slots 46 (FIG. 5), and each of the slots 46 extends partially through a height of the louver 42. The louvers 42 are oriented in parallel pairs, with one pair oriented perpendicular to the other pair. By aligning the slots 46 and inserting a slot 46 of one louver 42 into a slot 46 of another, intersecting louver 42, the louvers 42 of one pair are coupled to each of the louvers 42 of the other pair.

Figure 5B:
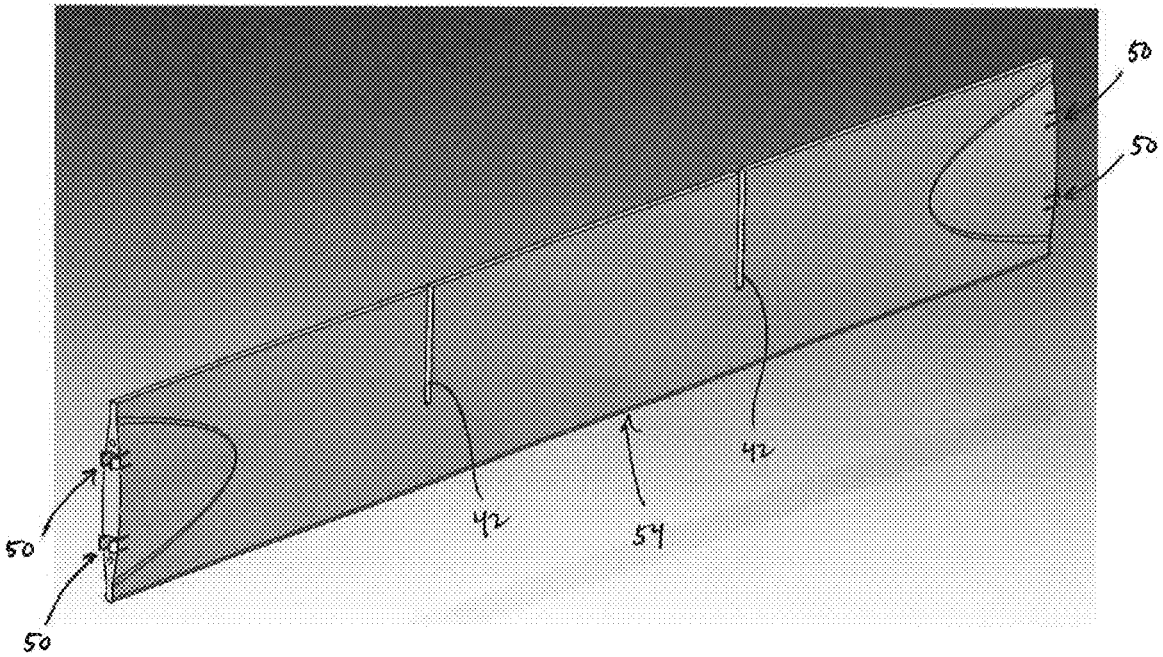
FIG. 5B is a perspective view of a louver according to another embodiment.
Figure 6:
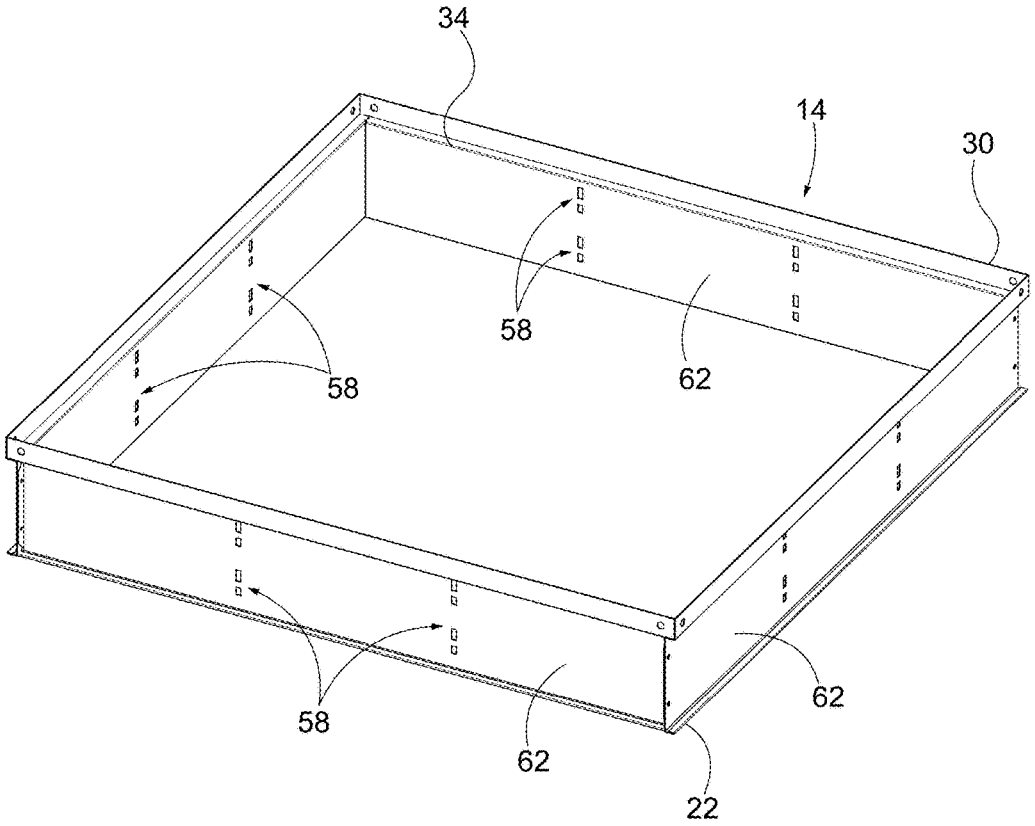
FIG. 6 is a perspective view of a housing.

In the illustrated embodiment, an end 50 of each louver 42 includes protrusions or tabs 54. The tabs 54 are inserted into associated openings 58 (FIG. 6) on an inner surface of the side walls 62 of the housing 14 (e.g., by snap-fit engagement). The tabs 54 can be oriented to protrude longitudinally from the end 50 of the louver 42, with an end of each tab 54 extending perpendicularly (e.g., vertically upward or downward) in order to engage an edge or surface of the housing 14. In the illustrated embodiment, the ends of the tabs 54 extend away from each other. In other embodiments, the tabs may be formed in a different manner. For example, as shown in FIG. 5B, tabs 56 may extend parallel to one another and be biased laterally outward from the louver 42 to engage the sides of the openings 58. In still other embodiments, the louvers 42 may be supported in the housing 14 in another manner.

Figure 7:
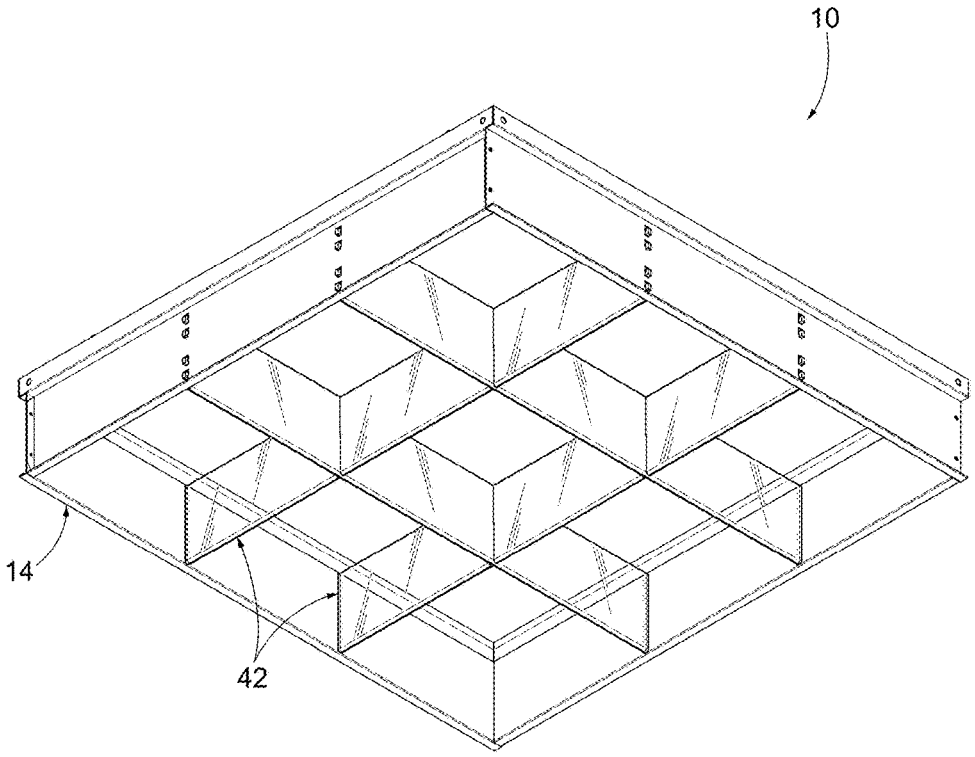
FIG. 7 is a perspective view of a light fixture according to another embodiment.
Figure 8:
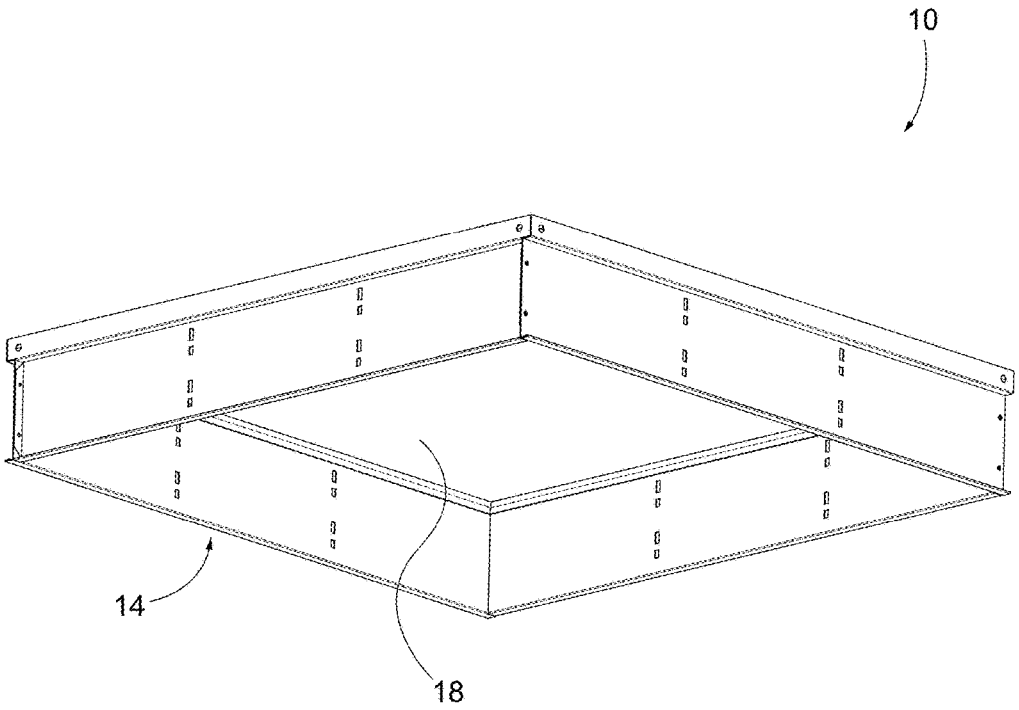
FIG. 8 is a perspective view of a light fixture according to another embodiment.

In the illustrated embodiment, each louver 42 has a substantially flat shape, such that each louver 42 includes a pair of parallel lateral sides. That is, each louver 42 has substantially planar side walls and forms a substantially flat plate. The louvers 42, however, may simulate a parabolic reflector. Also, in some embodiments (FIG. 5B), a portion of each louver 42 may have a parabolic shape. In the illustrated embodiment, the louvers 42 are opaque; in other embodiments (FIG. 7), the louvers 42 may be transparent or translucent. In still other embodiments (FIG. 8), the fixture 10 may omit any louvers 42, such that nothing is positioned below the light element 18.

Figure 9:
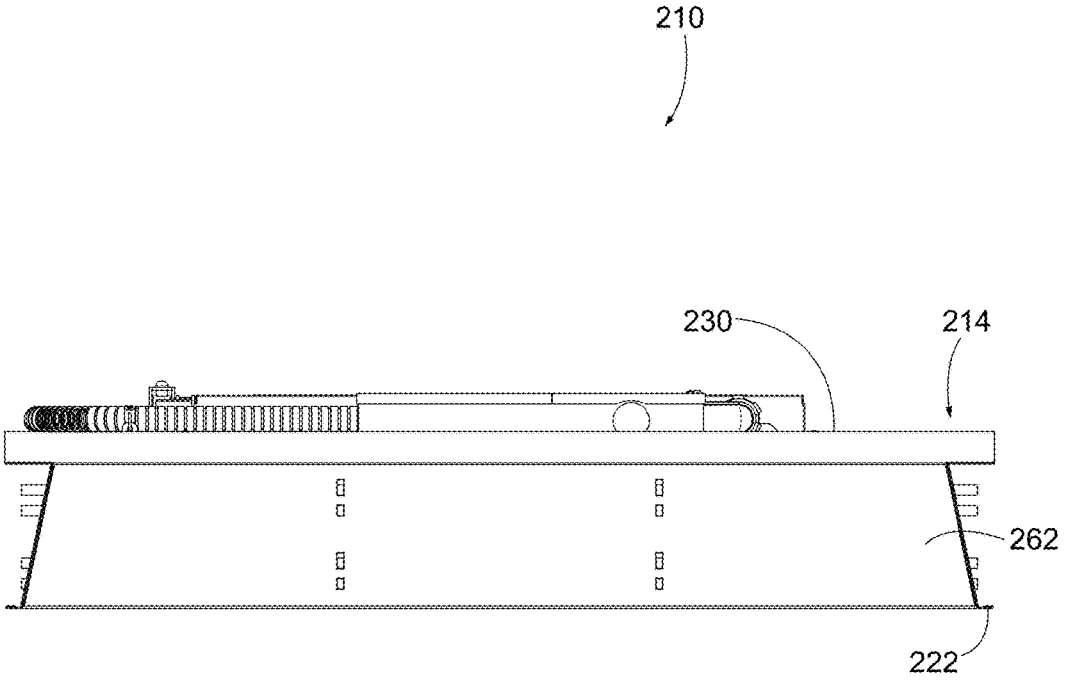
FIG. 9 is side view of a light fixture according to another embodiment.

FIG. 9 illustrates another embodiment of the fixture 210 in which the side walls 262 of the housing 214 are tapered. The side walls 262 taper outwardly toward the lower edge 222 of the housing 214, such that a distance between the side walls 262 proximate the upper edge 230 is less than a distance between the side walls 262 proximate the lower edge 222.

Figure 10:
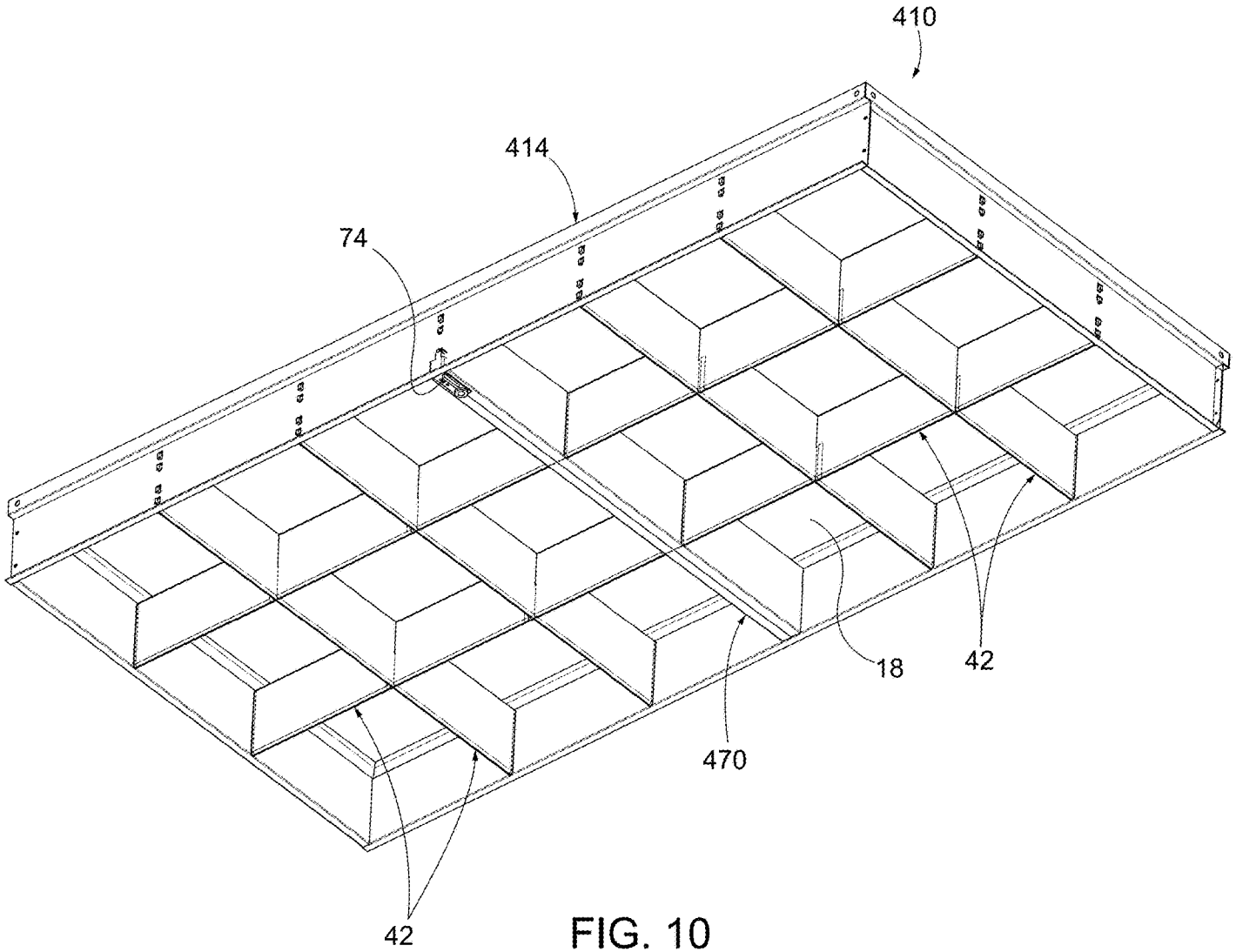
FIG. 10 is a perspective view of a light fixture according to another embodiment.

Also, in other embodiments (FIG. 10), the housing 414 may have a rectangular shape. For example, the length of the housing 14 in one dimension can be doubled, providing an elongated housing supporting two louver assemblies. A partition wall 470 can extend between the long sides of the housing 14 and be positioned between portions of the housing 414. The wall 470 may support the louvers 42. In some embodiments, the fixture 10 may include a sensor 74 (e.g., an occupancy sensor or motion sensor) for operating the light element 18.

Although various aspects have been described in detail with reference to certain embodiments, variations and modifications exist within the scope and spirit of one or more independent aspects as described. Various features and advantages are set forth in the following claims.

What is claimed is:

1. A light fixture comprising:

a housing including a lower edge, the housing configured to be recessed within a surface;

an edge-lit flat panel light supported in the housing, the edge-lit flat panel light including a planar surface spaced apart from the lower edge of the housing; and a plurality of louvers supported in the housing and positioned between the lower edge and the light emitting element, each of the louvers including a first planar side surface and a second planar side surface oriented parallel to the first planar side surface.

2. The light fixture of claim 1, wherein the louvers are translucent or transparent.

3. The light fixture of claim 1, wherein each of the louvers includes an end and a plurality of tabs extending from the end, the tabs engaging associated openings positioned in side walls of the housing.

4. The light fixture of claim 1, wherein the housing includes a laterally extending flange positioned adjacent an upper edge of the housing, wherein the edge-lit flat panel light is supported on the flange.

5. The light fixture of claim 1, wherein the housing includes a plurality of side walls extending between an upper edge and the lower edge, wherein the side walls are tapered such that a lateral distance between opposite side walls proximate the upper edge is less than a lateral distance between opposite side walls proximate the lower edge.

6. The light fixture of claim 1, wherein the plurality of louvers includes a pair of first louvers and a pair of second louvers, each of the first louvers including a first planar side surface and a second planar side surface oriented parallel to the first planar side surface, each of the second louvers including a first planar side surface and a second planar side surface oriented parallel to the first planar side surface, each of the second louvers oriented perpendicularly relative to each of the first louvers and engaging each of the first louvers.

7. A light fixture comprising:

a housing including a lower edge, an upper edge, and a plurality of side walls extending between the lower edge and the upper edge, the housing further including a laterally extending flange, the housing configured to be recessed within a surface;

an edge-lit flat panel light supported in the housing, the panel light supported on the flange and positioned adjacent the upper edge of the housing; and a plurality of louvers supported in the housing, the louvers positioned between the panel light and a lower edge of the housing, each of the louvers including a first planar side surface and a second planar side surface oriented parallel to the first planar side surface.

8. The light fixture of claim 7, wherein the louvers are translucent or transparent.

9. The light fixture of claim 7, wherein each of the louvers includes an end and a plurality of tabs extending from the end, the tabs engaging associated openings positioned in side walls of the housing.

10. The light fixture of claim 7, wherein the side walls are tapered such that a lateral distance between opposite side walls proximate the upper edge is less than a lateral distance between opposite side walls proximate the lower edge.

11. The light fixture of claim 7, wherein the plurality of louvers includes a pair of first louvers and a pair of second louvers, each of the first louvers including a first planar side surface and a second planar side surface oriented parallel to the first planar side surface, each of the second louvers including a first planar side surface and a second planar side surface oriented parallel to the first planar side surface, each of the second louvers oriented perpendicularly relative to each of the first louvers and engaging each of the first louvers.

* * * * *